US008876256B2

(12) United States Patent
Fricke et al.

(10) Patent No.: US 8,876,256 B2
(45) Date of Patent: Nov. 4, 2014

(54) PRINT HEAD DIE

(75) Inventors: Peter J. Fricke, Corvallis, OR (US); Ronald A. Hellekson, Eugene, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 246 days.

(21) Appl. No.: 13/365,258

(22) Filed: Feb. 3, 2012

(65) Prior Publication Data

US 2013/0201256 A1 Aug. 8, 2013

(51) Int. Cl.
*B41J 2/14* (2006.01)
*B41J 2/175* (2006.01)

(52) U.S. Cl.
USPC ..... 347/50; 347/85

(58) Field of Classification Search
CPC ..... B41J 29/02; B41J 2/1752; B41J 2/14072
USPC ..... 347/50, 85
See application file for complete search history.

(56) References Cited

U.S. PATENT DOCUMENTS

| | | | | |
|---|---|---|---|---|
| 7,104,624 | B2 | 9/2006 | Schloeman et al. | |
| 7,401,906 | B2 | 7/2008 | Hawkins et al. | |
| 7,604,312 | B2 | 10/2009 | Wade | |
| 7,938,501 | B2 | 5/2011 | Takamiya et al. | |
| 2002/0130912 | A1 | 9/2002 | Beck et al. | |
| 2003/0122898 | A1 * | 7/2003 | Beerling et al. | 347/57 |
| 2007/0195135 | A1 | 8/2007 | Kim et al. | |
| 2010/0188456 | A1 | 7/2010 | Gadke et al. | |

FOREIGN PATENT DOCUMENTS

KR 20100069210 6/2010

* cited by examiner

*Primary Examiner* — Jannelle M Lebron

(57) ABSTRACT

A print head die includes rows of nozzles. In one implementation, an electrical interconnect is electrically connected to the print head die along a major dimension of the die. In another implementation, a cross connect electrically connects a first column of a of nozzles to print a first color to a second column to print a second color. The cross connect connects the first and second columns between first and second ends of the first and second columns.

20 Claims, 6 Drawing Sheets

PRINT HEAD DIE

CROSS-REFERENCE TO RELATED PATENT APPLICATIONS

The present application is related to co-pending WIPO Application Serial No. PCT/US11/56315 filed on Oct. 14, 2011 by James M. Gardner, Peter J. Fricke and Mark A. Hunter, and entitled FIRING ACTUATOR POWER SUPPLY SYSTEM, the full disclosure of which is hereby incorporated by reference.

BACKGROUND

Page wide array print heads sometimes utilize a series of overlapping and staggered print head dies to print across a width of a medium in fewer passes or even a single pass. Printing with page wide array print heads may be subject to print quality defects due to spacing between overlapping print head dies. In some circumstances, page wide array print heads may also experience unacceptable parasitic electrical losses during delivery of electrical power to firing resisters of the print head dies.

DETAILED DESCRIPTION OF THE EXAMPLE EMBODIMENTS

Figure 1:
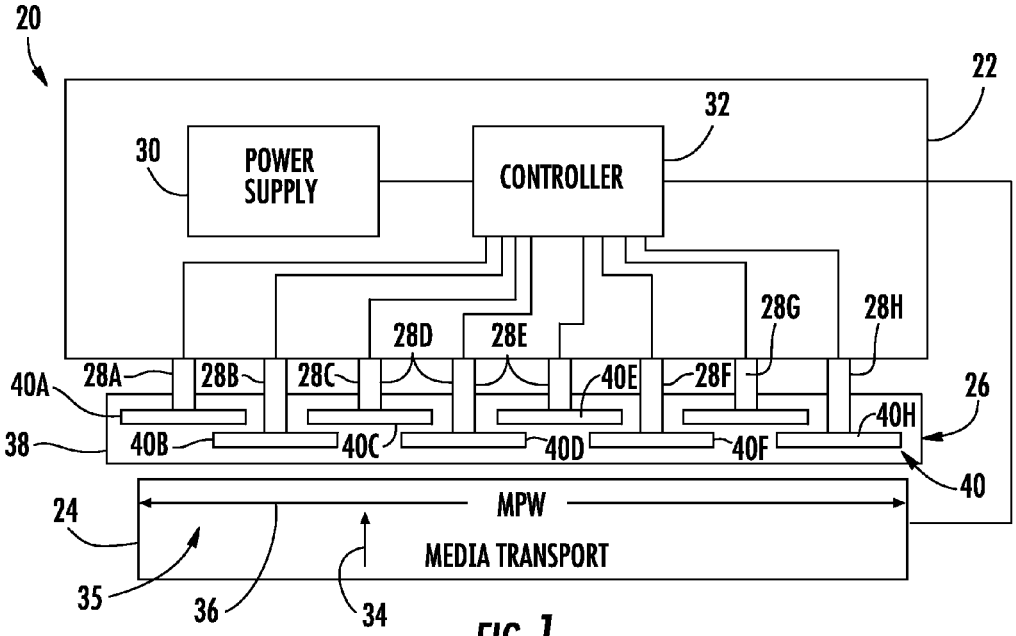
FIG. 1 is a schematic illustration of an example printing system including a page wide array of staggered and overlapping print head dies.

FIG. 1 illustrates an example printing system 20 with portions schematically shown. As will be described hereafter, printing system 20 communicates with multiple staggered and overlapping print head dies such that the print head dies may be more closely spaced to reduce print quality defects. Printing system 20 comprises a main control system 22, media transport 24, page wide array 26 and the electrical interconnects 28A, 28B, 28C, 28D, 28E, 28F, 28G and 28H (collectively referred to as interconnects 28).

Main control system 22 comprises an arrangement of components to supply electrical power and electrical control signals to page wide array 26. Main control system 22 comprises power supply 30 and controller 32. Power supply 30 comprises a supply of high voltage. Controller 32 comprises one or more processing units and/or one or more electronic circuits configured to control and distribute energy and electrical control signals to page wide array 26. Energy distributed by controller 32 may be used to energize firing resisters to vaporize and eject drops of printing liquid, such as ink. Electrical signals distributed by controller 32 control the timing of the firing of such drops of liquid. Controller 32 further generates control signals controlling media transport 28 to position media opposite to page wide array 26. By controlling the positioning a media opposite to page wide array 26 and by controlling the timing at which drops of liquid are eject or fired, controller 32 generates patterns or images upon the print media.

Media transport 24 comprises a mechanism configured to position a print medium with respect to page wide array 26. In one implementation, media transport 24 may comprise a series of rollers to drive a sheet of media or a web of media opposite to page wide array 26. In another implementation, media transport 24 may comprise a drum about which a sheet or a web of print media is supported while being carried opposite to page wide array 26. As shown by FIG. 1, media transport 28 moves print medium in a direction 34 along a media path 35 having a width 36. The width 36 is generally the largest dimension of print media that may be moved along the media path 35.

Page wide array 26 comprises support 38, printing liquid supplies 39 and print head dies 40A, 40B, 40C, 40D, 40E, 40F, 40G and 40H (collectively referred to as print head dies 40). Support 38 comprises one or more structures that retain, position and support print head dies 40 in a staggered, overlapping fashion across width 36 of media path 35. In the example implementation, support 38 staggers and overlaps printer dies 40 such that an entire desired printing width or span of the media being moved by media transport 34 may be printed in a single pass or in fewer passes of the media with respect to page wide array 26.

Figure 2:
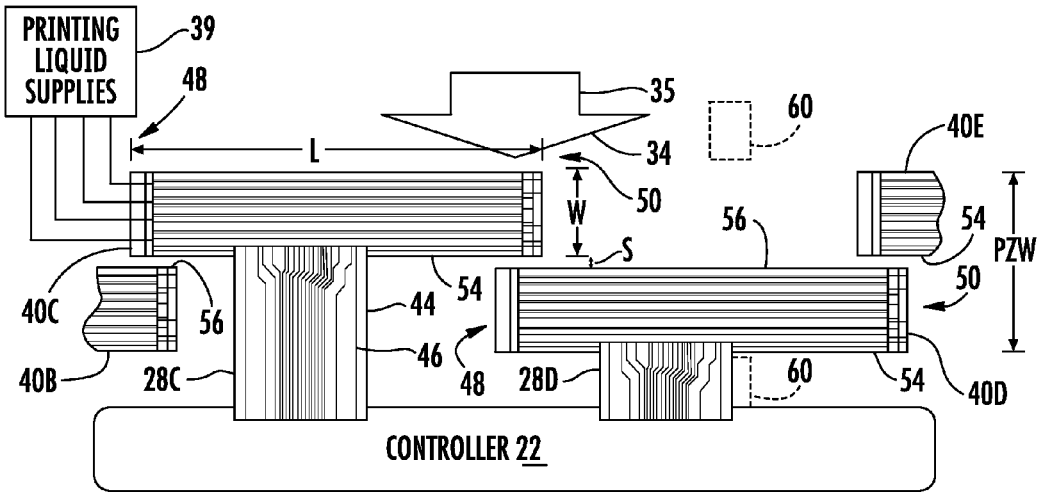
FIG. 2 is an enlarged view of a portion of FIG. 1 illustrating the example printing system.

Printing liquid supplies 39, one of which is schematically shown in FIG. 2, comprise reservoirs of printing liquid. Supplies are fluidly connected to each of dies 40 so as to supply printing liquid to dies 40. In one implementation, printing liquid supplies 39 supply multiple colors of ink to each of print head dies 40. For example, in one implementation, printing liquid supply 39 supplies cyan, magenta, yellow and black inks to each of dies 40. In one implementation, printing liquid supplies 39 are supported by support 38. In another implementation, printing liquid supplies 39 comprise off-axis supplies.

Print head dies 40 comprise individual structures by which nozzles and liquid firing actuators are provided for ejecting drops of printing liquid, such as ink. FIG. 2 illustrates print head dies 40C and 40D, and their associated electrical interconnects 28C and 28D, respectively, in more detail. As shown by FIG. 2, each of print head dies 40 has a major dimension, length L, and a minor dimension, width W. The length L of each print head die 40 extends perpendicular to direction 34 of the media path 35 while partially overlapping the length L of adjacent print head dies 40. The width W of each print head die 40 extends in a direction parallel to direction 34 of the media path 35.

Interconnects 28 comprise structures 44 supporting or carrying electrically conductive lines or traces 46 to transmit electrical energy (electrical power for firing resisters and electrical signals or controlled voltages to actuate the supply of the electrical power to the firing resisters) from controller 22 to the firing actuators of the associated print head die 40. Interconnects 28 are electrically connected to each of their associated print head dies 40 along the major dimension, length L, of the associated die 40. Interconnects 28 are spaced from opposite ends 48 and 50 of the associated print head die 40. Interconnects 28 do not extend between sides 54 and 56 of consecutive print head dies 40. Because interconnects 28 are spaced from opposite ends 48, 50 and do not extend between sides 54 and 56 of consecutive print head dies 40, interconnects 28 do not obstruct or interfere with overlapping of consecutive print head dies 40. As a result, dies 40 may be more closely spaced to one another in direction 34 (the media axis or media advanced direction) to reduce the spacing S between sides 54 and 56 of consecutive dies 40.

Because printing system 20 reduces the spacing S between sides 54, 56 of consecutive print head dies 40, printing system 20 has a reduced print zone width PZW which enhances dot placement accuracy and performance. In implementations in which different colors of ink are deposited by each of the print head dies 40, reducing the print zone width PZW allows different dies 40 to deposit droplets of colors on the print media closer in time for enhanced and more accurate color mixing and/or half-toning. In implementations in which media transport 24 drives or guides the print media opposite to dies 40 using one or more rollers 60 on opposite sides of the print zone, reducing the print zone with PZW allows such rollers 60 (shown in broken lines in FIG. 2) to be more closely spaced to each another adjacent to the print zone. As a result, skewing or otherwise incorrect positioning of print media opposite to print head dies 40 by rollers 60 is reduced to further enhance print quality.

In the example implementation illustrated, each of interconnects 28 is physically and electrically connected to an associated print head die 40 while being centered between opposite ends of length L. As a result, consecutive print head dies 40 on each side of the interconnects 28 may be equally overlap with respect to the intermediate print head die 40. In other implementations, interconnects 28 may be physically and electrically connected to an associated print head die 40 asymmetrically between ends 48, 50 of the die 40.

Figure 3:
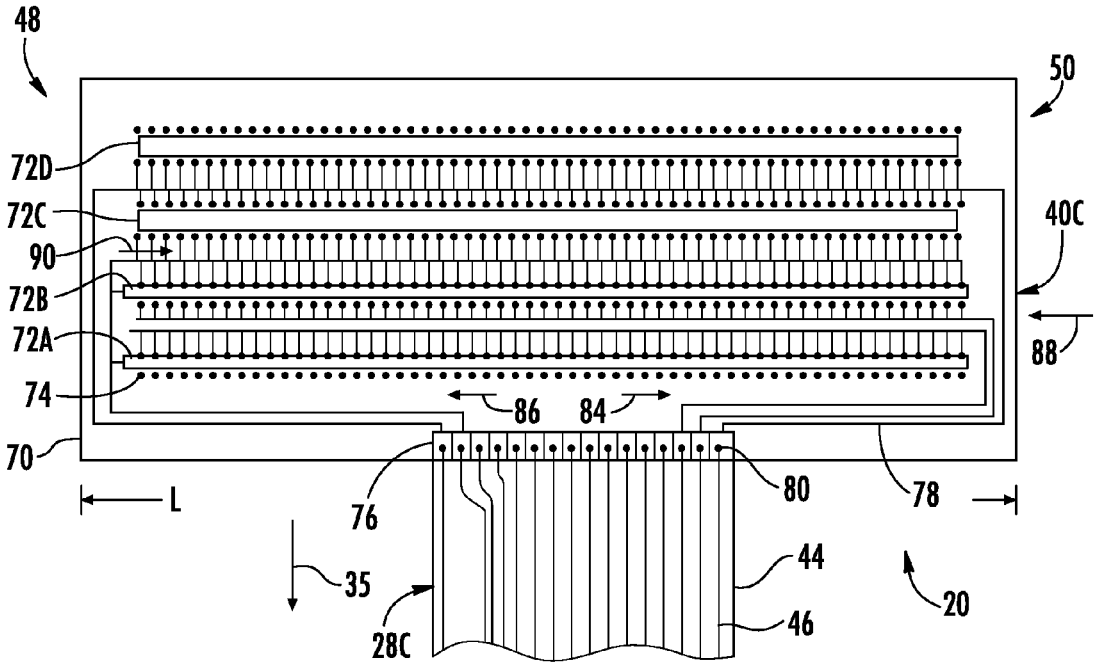
FIG. 3 is a schematic illustration of an example print head die and electrical interconnect of the printing system of FIG. 1.
Figure 4:
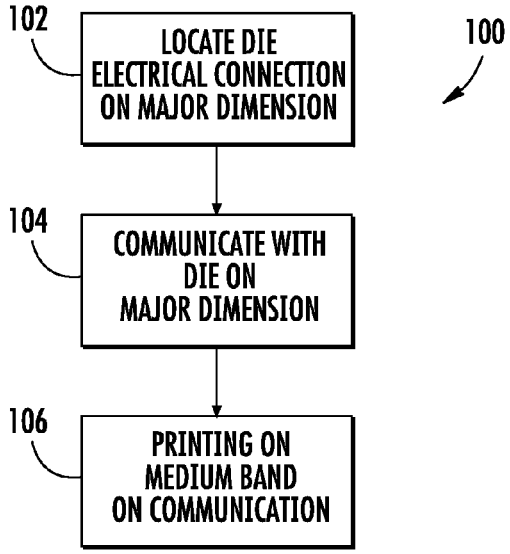
FIG. 4 is a flow diagram of an example method of use for the printing system of FIG. 1.

FIG. 3 schematically illustrates one example of print head die 40C and its associated electrical interconnect 28C. Each of the other print head dies 40 and their associated electrical interconnects 28 may be substantially identical to the print head die 40C and electrical interconnect 28C being shown. As shown by FIG. 3, print head die 40C comprises a substrate 70 forming or providing liquid feed slots 72A, 72B, 72C and 72D (collectively referred to as slot 72) to direct printing liquids received from supply 39 (shown in FIG. 2) to each of the nozzles 74 extending along opposite sides of each of slots 72. In one implementation, liquid feed slots 72 supply cyan, magenta, yellow and black ink to the associated nozzle 74 on either side of the slot 72.

Nozzles 74 comprise openings through which drops of printing liquid is ejected onto the print medium. In one implementation, print head die 40 comprises a thermoresistive print head in which firing actuators or resisters substantially opposite each nozzle are supplied with electrical current to heat such resisters to a temperature such that liquid within a firing chamber opposite each nozzle is vaporized to expel remaining printing liquid through the nozzle 74. In another implementation, print head die 40 may comprise a piezoresistive type print head, wherein electric voltage is applied across a piezoresistive material to cause a diaphragm to change shape to expel printing liquid in a firing chamber through the associated nozzle 74. In still other implementations, other liquid ejection or firing mechanisms may be used to selectively eject printing liquid through such nozzle 74.

To facilitate the supply of electrical current to the firing mechanisms associate with each of nozzle 74, print head die 40C further comprises electrical connectors 76 and electrically conductive traces 78. Electrical connectors 76 comprise electrically conductive pads, sockets, or other mechanisms or surfaces by which traces 78 of die 40C may be electrically connected to a corresponding electrically conductive traces 46 of electrical interconnect 28C. Electrical connectors 76 extend along the major dimension or length L of print head die 40C facilitate electrical connection of interconnect 44 to the major dimension or length L of print head die 40C. In the example illustrated, electrical connectors 76 comprise electrically conductive contact pads or contact surfaces against which electrical leads 80 of traces 46 are connected. In other implementations, the electrical connector 76 may comprise other structures facilitating electrical connection or electrical attachment of traces 46 of interconnect 28C to traces 78 of die 40C.

Electrically conductive traces 78 (a portion of which are schematically shown in FIG. 3) comprise lines of electrically conductive material formed upon substrate 70. Electrically conductive traces 78 transmit electrical power as well as electrical control signals to the firing mechanisms associate with each of nozzles 74. As shown by FIG. 3, electrically conductive traces 78 extend from electrical connectors 76 in outward directions 84, 86 perpendicular to the media path 35, extend around the ends of slots 72 and extend in inward directions 88, 90 between slots 72. Electrically conductive traces 78 are further connected to the liquid ejection mechanisms or firing actuators for each of nozzles 74. In one implementation, electrically conductive traces 78 extend between slots 72 from one end to the other end of die 40C. In another implementation, electrically conductive traces 78 extend between slots 72 from both ends 48, 50, one trace 78 extending a first portion of the distance from a left end 48 of die 40C and another trace 78 extending a portion of the distance from a right end 50 of die 40C. In yet other implementations, other tracing patterns or layouts may be employed.

One implementation, electrical interconnects 28 each comprise a flexible circuit. In another implementation, electrical interconnects 28 each comprise a rigid circuit board. In one implementation, electrical interconnects 28 have a width of approximately 7.6 mm. In another implementation, electrical interconnects 28 have a width of approximately 5.6 mm. In one implementation, slots 72 of each print die 40 have a centerline-to-centerline pitch of between 1 and 2 mm. In one implementation, slot 72A of one print head die 40 and slot 72D of a consecutive print head die 40 have a centerline-to-centerline spacing in direction of media path 35 of less than 5 mm. In one implementation, the spacing S is less than or equal to 2 mm. Although system 20 is illustrated as including eight print head dies 40, in other implementations, system 20 may have other numbers of print head dies 40. For example, in one implementation in which media path 35 is 8.5 inches wide, system 20 comprises 10 staggered and overlapping print head dies 40 that collectively span the 8.5 inches. In other implementations, system 20 may have other configurations and dimensions to accommodate other media path widths.

Figure 5:
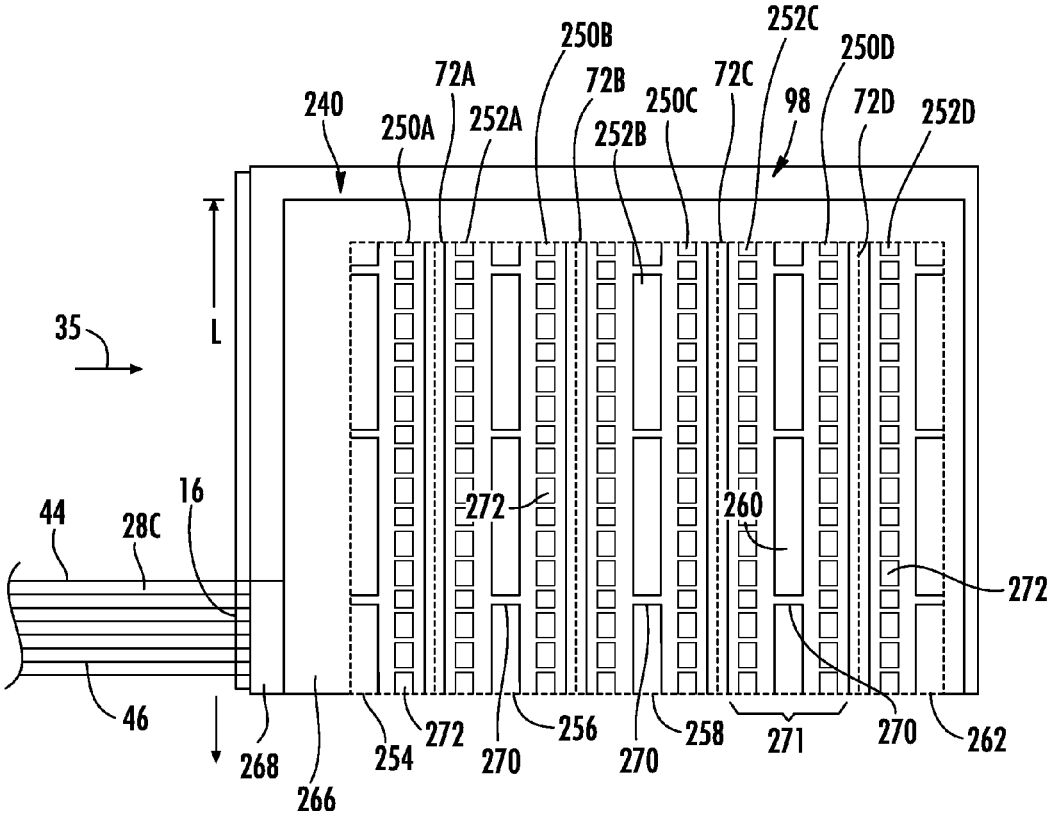
FIG. 5 is a fragmentary schematic illustration of another example print head die and electrical interconnect for the printing system of FIG. 1.

FIG. 5 is a flow diagram of a method 100 for printing upon a medium. As indicated by step 102, electrical connectors for a print head die are located on a major dimension of a print head die which extends perpendicular to a media advance direction or media path. As indicated by step 104, and electrical connection is made to the electrical connectors on the major dimension to facilitate communication with the die on the major dimension. In one implementation, such communication may be made using a printed circuit board or a flexible circuit connected to the die electrical connectors. As indicated by step 106, based upon the electrical signals and electrical powers supplied to the die via its electrical connectors on the major dimension, printing upon a medium is carried out. As noted above, because communication with each print head die 40 occurs on the major dimension of the die, the spacing between consecutive overlapping dies and the print zone width may be reduced to enhance print quality.

In the example architecture shown in FIG. 3, the length of electrically conductive traces 78 extending around ends of slot 72 as well as the relatively small pitch of slots 72, which drives the width of traces 78 downward, results in increased electrical resistance in the internal power supply path from power supply 30 (shown in FIG. 1) to the firing actuator of nozzle 74. In one implementation, this energy efficiency of the power supply path is less than 90%. In other words, at least 10% of electrical power is lost due to the increased electrical resistance experienced by the internal power supply path.

Figure 6:
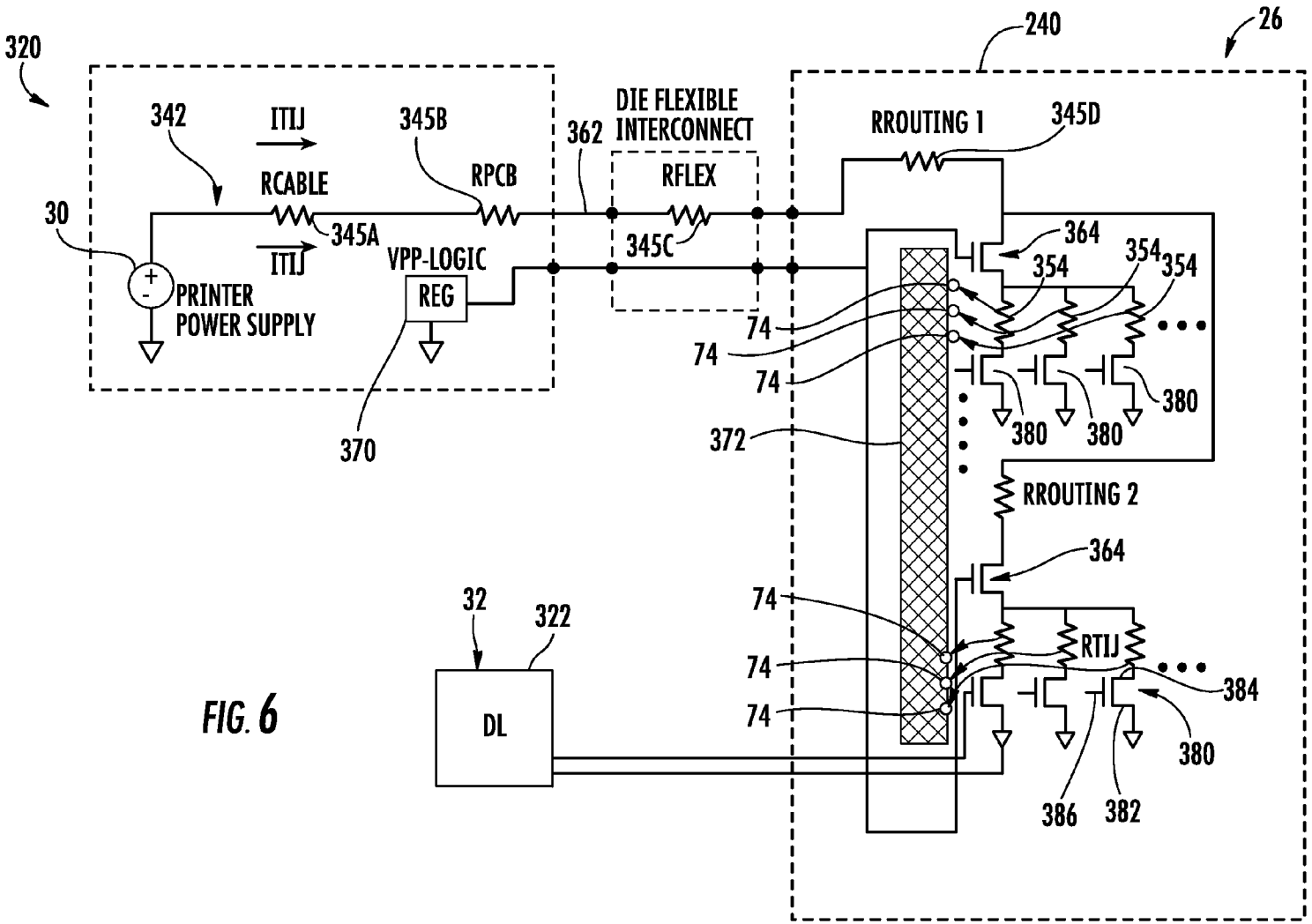
FIG. 6 is a circuit diagram of another example of the printing system of FIG. 1.
Figure 7:
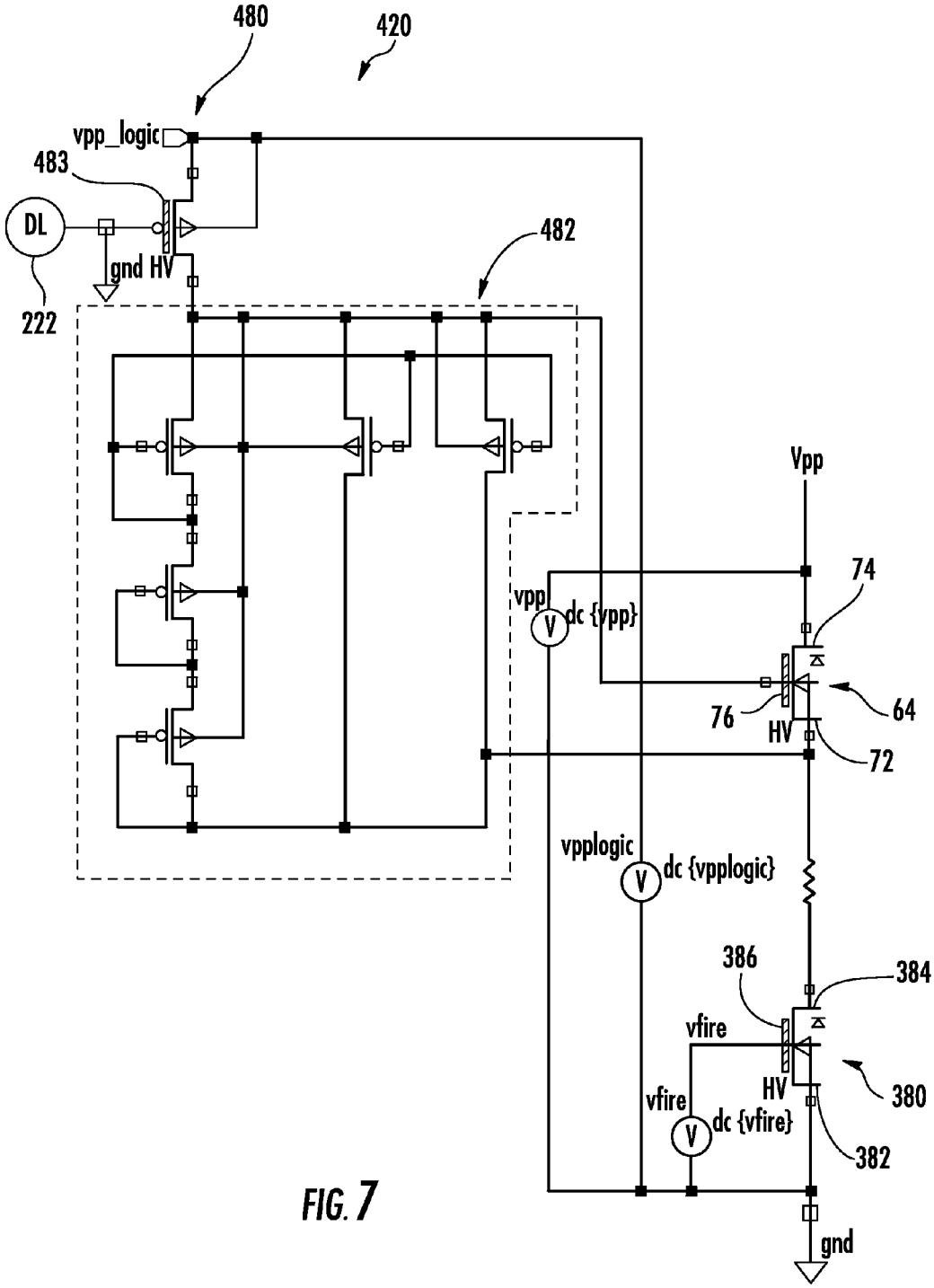
FIG. 7 is a circuit diagram of another example of the printing system of FIG. 1.

FIGS. 5-7 illustrate example implementations by which parasitic electrical losses resulting from the length of electrically conductive traces 78 and the relatively small sizing of traces 78 may be reduced. FIG. 5 illustrates an end portion of an example print head die 240 which may be utilized in system 20 for each of print head dies 40. Print head die 240 is similar to print head die 40C (each of the other print head dies 40 of system 20) in that print head die 240 receives electrical power and electrical data signals (printing signals or logic voltages) through interconnect 28C which is connected to connectors 76 along the major dimension, length L, which extends perpendicular to the media advance direction or media path 35. However, as will be described hereafter, print head die 240 additionally utilizes electrical cross connects to reduce electrical resistance and parasitic losses.

As shown by FIG. 5, print head die 240 comprises slots 72 (described above with respect to print head die 40C in FIG. 3), nozzle columns 250A, 250B, 250C and 250D (collectively referred to as nozzle columns 250), nozzle columns 252A, 252B and 252C, 252D (collectively referred to as nozzle columns 252), column circuits 254, 256, 258, 260 and 262, Vpp bus or trace 266, Pgnd bus or trace 268 and cross connects 270. Nozzle columns 250 are supported by ribs 271 adjacent to a left side of each of slots 72. Nozzle columns 252 are supported by ribs adjacent to a right side of each of slots 72. Each of nozzle columns 250, 252 comprise a plurality of nozzles 74 (shown in FIG. 3) and an associated printing liquid firing actuator or mechanism 272 (schematically shown as boxes). Each printing liquid firing mechanism 272 receives ink or other printing liquid from the adjacent slot 72, whereby the printing liquid or ink is selectively ejected through the associated nozzle 74 using supplied voltages across Vpp and Pgnd. Column circuits 254-262 generally designate electrical traces for transmitting other data and control signals for each of the liquid firing mechanisms 272 of the adjacent nozzle columns 250, 252.

Vpp (printing power voltage) trace 266 comprises a layer of electrically conductive material extending from an associated one of electrical connectors 76 (which is connected to a power source 30) about a periphery of die 240. Vpp trace 266 further extends down each rib 271 and down each nozzle column 250, 252. Vpp trace 266 is electrically connected to each of liquid firing mechanisms 272 of adjacent nozzle columns 250, 252.

Pgnd (printer ground) bus or trace 268 comprises a layer of electrically conductive material extending from an associated one of electrical connectors 76 (which is grounded) about a periphery of die 240. Pgnd trace 268 further extends down each rib 271 and down each nozzle column 250, 252. Pgnd trace 268 is electrically connected to each of liquid firing mechanisms 272 of adjacent nozzle columns 250, 252. In the implementation illustrated, the layers of Vpp trace 266 and Pgnd trace 268 are stacked with an intermediate dielectric layer therebetween. Vpp trace 266 and Pgnd trace 268 cooperate to provide an electrical voltage across the resisters of liquid firing mechanisms 272 in response to control signals from controller 32. In one implementation, such control signals comprise electrical signals communicated to transistors of the liquid firing mechanism 272.

Cross connects 270 comprise electrically conductive bridges extending across the circuit columns 254-262 to electrically connect columns 250 and 252 on opposite sides of each rib 271. In the example illustrated, each cross connect 270 is multilayered, comprising a stack of a Vpp trace layer (for connection to Vpp traces 266), a Pgnd trace layer (for connection to Pgrnd traces 268) and an intermediate dielectric layer. In other implementations, cross connects to 70 may comprise side-by-side electrically conductive portions which are electrically insulated from one another and which electrically connect Vpp traces 266 and Pgnd traces 268, respectively.

In the portion of the example print head die 240 illustrated by FIG. 5, three spaced cross connects 270 span or cross circuit column 254 to directly connect portions of Vpp trace 266 and Pgnd trace 268 (underlying and electric insulated from trace 266) on the left side of circuit column 254 (closest to electrical connectors 76) to portions of VPP trace 266 and Pgnd 268 of nozzle column 250A on a left side of slot 72A. Print head die 240 additionally comprises three spaced cross connects 270 located intermediate opposite ends of slot 72 and extending across circuit column 256 to electrically connect portions of Vpp trace 266 and Pgnd trace 268 of nozzle column 252A to portions of Vpp trace 266 and Pgnd trace 268 of nozzle column 250B. Cross connects 270 are further provided to electrically connect portions of Vpp trace 266 and Pgnd 268 of each nozzle column to one another. Cross connects 270 are further provided to directly electrically connect those portions of Vpp trace 266 and Pgnd 268 of the outermost nozzle column 252D with the outer rightmost periphery portions of Vpp trace 266 and Pgnd trace 268. As a result, cross connects 270 provide additional electrical conduction shortcut paths to reduce electrical resistance and to reduce parasitic electrical losses, enhancing energy efficiency of the overall power supply path to each of liquid firing actuators 272. Outer rightmost periphery parasitic is therefore also balanced with rib parasitics of rib to left of rightmost slot 72D.

FIG. 6 schematically illustrates printing system 320, another example of printing system 20. Printing system 320 comprises media transport 30 (shown in FIG. 1), page wide array 26 (shown in FIG. 1) including print head dies 240 (shown and described above with respect to FIG. 5), power supply 30, printing liquid supplies 39 (shown in FIG. 2), controller 32 including digital logic 322 and firing inkjet resistor power supply system 342. As shown by FIG. 6, print head die 240 comprises a multitude of nozzles 74 (schematically shown) and associated firing actuators 354 (shown as firing resistors) arranged along an ink slot 372 to supply ink or other liquid to actuators 354 and nozzles 74. Each of firing actuators 354 receives electrical power from inkjet resistor power supply system 342.

Resistor power supply system 342 supplies electrical power to each of actuators 354 with less variance in spite of the resistances 345A, 345B, 345C and 345D along internal power supply path 362 which may introduce parasitic voltage losses. In particular, resistor 345A represents the resistance through a cable to the printed circuit board. Resistor 345B represents resistance of the path 362 on the printed circuit board. Resistor 345C represents resistance a path 362 on a flexible circuit connecting the printed circuit board to the die 344. Resistor 345D represents electrical resistance of the routing (traces) on die 240 from the flexible circuit to transistors 64. The electrical resistance of the routing or traces on die 240 may vary depending upon the location of the particular nozzle 74 and associated actuator 354. For example, an actuator 354 located near the middle of a printing slot 372 may experience higher parasitic voltage drops than an actuator 354 located near the ends of slot 372. Such print head or die induced variations may worsen as the print heads become narrower and include fewer layers of metal to route power, which results in increased parasitic voltage drops.

Inkjet firing actuator power supply system 342 comprises power supply 30, internal power supply path 362, high side switching (HSS) transistors 364, voltage regulator 370 and low side switching (LSS) transistors 380.

High side switching (HSS) transistors 364 comprise transistors in a source follower arrangement. In particular, each transistor 364 has a source electrically connected to actuator 354, a drain electrically connected to internal power supply path 362 and a gate electrically connected to voltage regulator 370. In other words, the source of transistor 364 is in closer electrical proximity to actuator 354 or the drain of transistor 364 is in closer electrical proximity to path 362. In a "source follower arrangement", the voltage seen at the source of transistor 364 follows the voltage at the gate of transistor 364.

According to one example, each transistor 364 comprises a power field effect transistor, such as a MOSFET transistor. According to one example, each transistor 364 comprises a LDMOS transistor. In other examples, each transistor 364 may comprise other forms of transistors which similarly selectively transmit a voltage to actuator 354 which follows the voltage presented at the associated gate.

Voltage regulator 370 comprises an electrical circuit or other electrical voltage regulation device configured or constructed to provide the gate of transistor 364 with a controlled voltage that is no greater than a concurrent voltage at the drain. As a result, transistor 364 absorbs voltage fluctuations on the main power system rail including voltage fluctuations of path 362. As a result, transistor 364 and voltage regular 370 cooperate to deliver constant energy to the one or more actuators 354. By delivering a more stable or uniform voltage to the inkjet firing actuators 354, power supply 342 provides more uniform firing energy and reduces any over energy range seen at actuator 354 to increase reliability and performance.

Moreover, in printing systems where motors and other various mechanical systems utilize a voltage different than the desired inkjet resistor firing voltage, the cooperation of voltage regulator 370 and transistor 364 also allows the resistor firing voltage to be isolated from those voltages of the printing system 20 that are used to drive such motors and mechanical systems of printing system 20. With a predictable stable voltage at each actuator 354 across all load conditions, printers may utilize appropriate energetic settings that increase nozzle life and performance. By isolating the resistor firing voltage from those voltages that drive other printing system components, power supply 342 facilitates use of a mechanical system voltage different from a target resistor firing voltage, enhancing printer design flexibility.

In the example illustrated, voltage regulator 370 provides a controlled voltage that is less than a minimum system power supply voltage under maximum load. In the example illustrated, voltage regulator 370 provides a separate regulated voltage that is a several volts lower than the voltage of a main power supply, power supply 30. In other examples, voltage regulator 370 may provide other voltages to the gate of transistor 364. In the example illustrated, voltage regulator 370 is implemented as part of main control system 22. In other examples, voltage regulator 370 may be implemented directly on page wide array 26 or at other locations.

LSS transistors 380 each comprise a power field effect transistor, such as a LDMOS transistor, having a source 382 connected to ground, a drain 384 electrically connected to an end of actuator 354 and a gate 386 electrically connected to nozzle drive logic and circuitry, digital logic 322. For ease of illustration, FIG. 6 merely illustrates a few of the electrical connections between digital logic 222 and a few of gates 386 of a few LSS transistors 380.

As shown by FIG. 6, each nozzle 74 and associated actuator 354 has a dedicated LSS transistor 380. Each LSS transistor 380 serves as a switching mechanism to selectively fire its associated actuator 354 and nozzle 74 in response to control signals from digital logic 322. Because inkjet firing actuator power supply system 342 includes LSS transistors 380 for selectively actuating individual actuators 54, illustrated as firing resistors, and nozzles 74, the HSS transistor 364 may be shared amongst multiple nozzles 74 and actuators 354. According to one example, a single HSS transistor is shared amongst up to 12 nozzles 74 and actuators 354 (the set of nozzles 74 and firing actuators 354 for sharing an HSS transistor sometimes referred to as a primitive). Because LSS transistors 380 may be less space consuming and less expensive as compared to HSS transistors 364, cost and die space consumption are reduced.

FIG. 7 is a circuit diagram of an example printing system 420. Printing system 420 is similar to printing system 320 except that printing system 420 is additionally illustrated as including an example level shifter 480 and an example clamping circuit 482. Level shifter 480 is similar to level shifter 480 described above. Level shifter 480 serves as switching mechanisms by which digital logic 222 of controller 32 to (shown in FIG. 6) selectively applies a gate voltage to the gate of each transistor 364 when one of the actuators 354 sharing transistor 364 and its associated nozzle 74 are to be fired. In particular, in response to receiving a low voltage digital signal from digital logic 322, a level shifter 480 supplies the gate of transistor 364 (and clamp circuit 482) with higher controlled or regulated voltage ($VPP_{logic}$) established by regulator 370. Because transistor 364 is in a source follower arrangement, the voltage seen at actuator 354 corresponds to the regulator controlled $VPP_{logic}$ provided at the gate of transistor 364 in response to actuation or switching of level shifter 480. Note that in the arrangement shown in FIG. 7, the supply of the voltage to the gate of transistor 364 upon actuation of level shifter 480 will not result in firing of the actuator 354 and nozzle 74 (shown in FIG. 6) until the LSS transistor 380 is actuated or turned on. Note further that although level shifter 480 is functionally represented with a single transistor 483, as a high-voltage PMOS device, in the example illustrated, level shifter 480 includes multiple high-voltage transistors, namely, two high voltage PMOS devices, two LDMOS transistors and digital CMOS gates.

Clamp circuit 482 is provided on die 240 for each HSS transistor 364. Each clamp circuit 482 comprises diode connected devices which turn on in response to the gate-to-source voltage becoming too high to limit the gate-source voltage as the voltage is pulled up to match the gate voltage (the voltage at gate of HSS 364) (minus some diode voltage drops). In other examples, clamp circuits 482 may have other configurations or may be omitted.

Because printing system 420 employs a LSS transistor 380 for each firing actuator 354 and associated nozzle 74, multiple nozzles 74 or primitives may share a single HSS transistor 364. As a result, the nozzles 74 of such primitives may also share a single level shifter 480 and a single clamping circuit 482. Consequently, additional cost and space are conserved.

Figure 8:
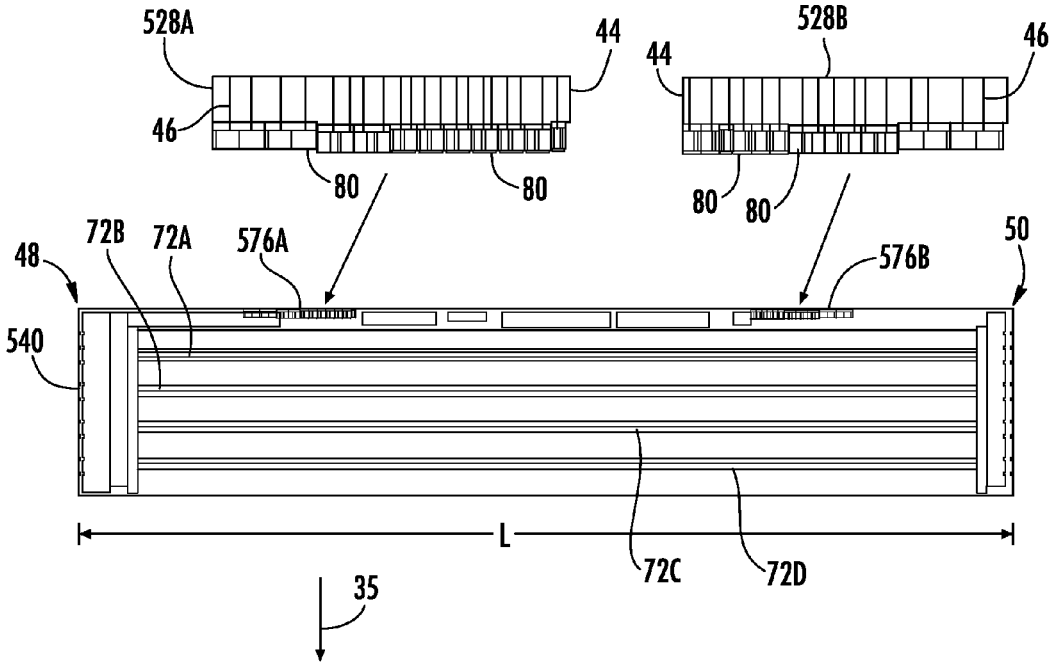
FIG. 8 is a schematic illustration of another example print head die and electrical interconnect of the printing system of FIG. 1.

FIG. 8 schematically illustrates an example of print head die 540 and its associated electrical interconnects 528A and 528B (collectively referred to as interconnects 528). Print head die 540 and electrical interconnects 528 may be used in place of one or more of print head dies 40 and one or more of electrical interconnects 28 in system 20 shown in FIG. 1. Like print head die 240 (shown in. 4), print head die 540 utilizes cross connects 270 to reduce parasitic losses. Print head die 540 is identical to print head die 240 except that print head 540 comprises two series or sets of electrical connector sets 576A and 576B (collectively referred to as connector sets 576) located along the major dimension, length L, of die 540 which extends perpendicular to the media advanced direction of flow path 35. Connector sets 576 are themselves similar to electrical connectors 76 (described above) except that the number of electrical connections utilized by the firing actuators and nozzles of print head die 540 are apportioned between or amongst the connector sets 576. In one implementation, each of connector sets 576 includes a connector connected to a Vpp bus or trace 266 (shown and described above with respect to print head die 240) and another connector (such as a connector pad) connected to a Vgnd bus or trace 268 (shown in described above with respect to print head die 240). Each connector set 576 may include other connectors for other functions as well such as data, negative and positive clocks, sensor such as thermal sensors, logic voltages (Vdd), serial control interfaces and the like.

In the example illustrated, connector sets 576 are each spaced from the opposite ends 48, 50 of print head die 540 by substantially equal distances. In other implementations, connector sets 576 are asymmetrically positioned along the major dimension, length L, of print head die 540. Because print head die 540 includes a plurality of connector sets 576, comprised of connectors 80, are spaced closer to ends 48, 50 as compared to a single connector set centrally located between ends 48, 50. As a result, the length of the electrically conductive traces, such as Vpp trace 266 and Pgnd trace 268 (shown in FIG. 5) may be reduced. As a result, parasitic electrical losses caused by the resistance of the narrow and long electrically conductive traces may be reduced.

Interconnects 528 are similar to interconnects 28 except that the electrical traces of interconnects 28 are apportioned between or amongst interconnects 528. As with interconnects 28, interconnects 528 comprise structures 44 supporting or carrying electrically conductive lines or traces 46 to transmit electrical energy (electrical power and electrical signals) from controller 22 to the nozzles of the associated print head die 540. Interconnects 528 or electrically connected to print head die 540 along the major dimension, length L, of the associated die 540. Interconnects 528 are spaced from opposite ends 48 and 50 of print head die 540. Interconnects 528 do not extend between consecutive print head dies 540. Because interconnects 28 are spaced from opposite ends 48, 50 and do not extend beyond around and 48, 50 of print head die 540, interconnect 28 does not obstruct or interfere with overlapping of consecutive print head dies 540. As a result, a plurality of staggered and over lapping dies 540 may be more closely spaced to one another in media path direction 35 (the media axis or media advanced direction) to reduce the spacing between sides of consecutive dies 540.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus for comprising:

a media path along which the media to be printed upon is moved;

a first print head die comprising:

first nozzles;

first slots through which printing liquid is supplied to the first nozzles, the first print head die having a major dimension perpendicular to the media path and a minor dimension;

first electrical connectors along the major dimension; and first electrically conductive traces extending in a first direction from the first electrical connectors perpendicular to the media path, around an end of the first slots, and in a second direction between the first slots; and a first interconnect connected to the first print head die, the first interconnect having first electrical connections connected to the first electrical connectors along the major dimension.

2. The apparatus of claim 1, wherein the first slots have a pitch of less than or equal to 1 mm.

3. The apparatus of claim 1 further comprising:

a firing actuator associated with one of the first nozzles;

an internal power supply; and an internal power supply path from the power supply to the firing actuator, wherein the power supply path has an energy efficiency of less than 90%.

4. The apparatus of claim 1, wherein the electrical interconnect comprises a flexible circuit.

5. The apparatus of claim 1 further comprising a second electrical interconnect connected to the first print head die, the second interconnect having a second electrical connections connected to the first electrical connectors along the major dimension.

6. The apparatus of claim 1 further comprising an electrostatic discharge circuit beneath the first electrical connectors.

7. The apparatus of claim 1, wherein the media path is configured to accommodate a maximum width of media, wherein the apparatus further comprises a plurality of print head dies, including the first print head die, and wherein the plurality of print head dies are arranged to collectively span the maximum width.

8. The apparatus of claim 1, wherein the first electric conductive traces comprise an individual electrically conductive trace continuously extending from one of the first electrical connectors, perpendicular to the media path, around an end of at least one of the first slots and in a second direction, opposite to the first direction, between two slots of the first slots.

9. The apparatus of claim 1, wherein the first interconnect cantilevers the first print head die above the media path.

10. The apparatus of claim 1, wherein the first interconnect and the first print head die have a T-shaped top profile.

11. The apparatus of claim 1, wherein the first nozzles are arranged in a first row to print a first color and a second row to print a second color, wherein the first row of the first nozzles includes a first column having first and second ends, wherein the second row of the first nozzles includes a second column having first and second ends and wherein the die further comprises a first cross connect electrically connecting the first column and the second column between the first and second ends of the first column and of the second column.

12. The apparatus of claim 11, wherein the first cross connect extends perpendicular to the first column.

13. The apparatus of claim 1 further comprising:

a second print head die staggered with respect to the first print head die and supported independent of the first print head die, the second print head die comprising:

second nozzles;

second slots through which printing liquid is supplied to the second nozzles, the second print head die having a major dimension perpendicular to the media path and a minor dimension;

second electrical connectors along the major dimension; and second electrically conductive traces extending in a first direction from the second electrical connectors perpendicular to the media path, around an end of the second slots, and in a second direction between the second slots; and a second interconnect connected to the second print head die, the second interconnect having a second electrical connections connected to the second electrical connectors along the major dimension.

14. The apparatus of claim 13, wherein the first slots include a first slot closest to the second print head die, wherein the second slots include a second slot closest to the first print head die and wherein the first slot and the second slot have centerlines spaced less than or equal than 5 mm.

15. The apparatus of claim 13, wherein the major dimension of the second print head die extends parallel to the major dimension of the first print head die.

16. The apparatus of claim 13, wherein the first interconnect has a first length perpendicular to the major dimension of the first print head die and wherein the second interconnect has a second length perpendicular to the major dimension of the second print head die, the second length being less than the first length.

17. The apparatus of claim 13, wherein the first print head die has a first edge extending along the major dimension of the first print head die and wherein the second print head die has a second edge extending along the major dimension of the second print head die, at least a portion of the second edge facing the first edge and being spaced from the first edge by an air gap.

18. The apparatus of claim 13, wherein the first interconnect cantilevers the first print head die opposite the media path and wherein the second interconnect cantilevers the second print head die opposite the media path.

19. The apparatus of claim 13 further comprising a third print head die staggered with respect to the first print head die and aligned with the second print head die.

20. A method comprising:

providing a print head die comprising:

first nozzles;

first slots through which printing liquid is supplied to the first nozzles, the first print head die having a major dimension perpendicular to the media path and a minor dimension;

first electrical connectors along the major dimension; and first electrically conductive traces extending in a first direction from the first electrical connectors perpendicular to the media path, around an end of the first slots, and in a second direction between the first slots; and communicating with the print head die across an electrical interconnect having electrical connectors connected to the electrical connectors along the major dimension; and printing upon a print medium based upon the communication with the print head die.

* * * * *

UNITED STATES PATENT AND TRADEMARK OFFICE

CERTIFICATE OF CORRECTION

PATENT NO. : 8,876,256 B2
APPLICATION NO. : 13/365258
DATED : November 4, 2014
INVENTOR(S) : Peter J. Fricke et al.

It is certified that error appears in the above-identified patent and that said Letters Patent is hereby corrected as shown below:

On the Title page, in item (57), Abstract, in column 2, line 6, delete "of a of" and insert -- of --, therefor.

Signed and Sealed this
Twenty-eighth Day of April, 2015

Michelle K. Lee

Michelle K. Lee
*Director of the United States Patent and Trademark Office*